US005802615A

United States Patent [19]

Wenk

[11] Patent Number: 5,802,615

[45] Date of Patent: Sep. 8, 1998

[54] WEIGHTED GOLF GLOVE

[76] Inventor: Ron J. Wenk, 63 Landover Dr., Coatesville, Pa. 19320

[21] Appl. No.: 812,353

[22] Filed: Mar. 5, 1997

[51] Int. Cl.[6] ..... A41D 11/00

[52] U.S. Cl. ..... 2/161.2; 2/161.4; 2/161.1; 2/160; 2/917

[58] Field of Search ..... 2/160, 161.1, 161.2, 2/161.4, 18, 19; 482/44, 50, 105

[56] References Cited

U.S. PATENT DOCUMENTS

| | | | |
|---|---|---|---|
| 889,397 | 6/1908 | O'Shaughnessy | 2/161.1 X |
| 4,247,097 | 1/1981 | Schwartz | 482/44 X |
| 4,371,983 | 2/1983 | Piotti | 2/160 X |
| 4,684,123 | 8/1987 | Fabry | 2/160 |
| 4,911,433 | 3/1990 | Walker et al. | 482/105 |
| 5,386,591 | 2/1995 | Canan | 2/160 |

*Primary Examiner*—C. D. Crowder
*Assistant Examiner*—Shirra L. Jenkins

[57] ABSTRACT

A new Weighted Golf Glove for improving a golfer's golf swing and thereby helping a golfer improve his or her golf game. The inventive device includes a glove including a palm portion, a back portion, finger stalls, a thumb stall, and a wrist portion cooperatively joined together to fit a wearer's hand and a pocket provided intermediate the wrist portion and the thumb stall of the glove wherein the pocket is adapted for receiving and holding a generally flexible conforming weight capable of conforming in use to the shape of the ball of the thumb of a wearer's hand.

20 Claims, 3 Drawing Sheets

WEIGHTED GOLF GLOVE

BACKGROUND OF THE INVENTION

1. Field of the Invention

The present invention relates to weighted gloves and more particularly pertains to a new Weighted Golf Glove for improving a golfer's golf swing and thereby helping a golfer improve his or her golf game.

2. Description of the Prior Art

The use of weighted gloves is known in the prior art. More specifically, weighted gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art weighted gloves include U.S. Pat. Nos. 4,684,123; 4,911,433; Design U.S. Pat. No. 348,090; U.S. Pat. Nos. 4,034,979; and 4,247,097.

While these devices fulfill their respective, particular objectives and requirements, the aforementioned patents do not disclose a new Weighted Golf Glove. The inventive device includes a glove including a palm portion, a back portion, finger stalls, a thumb stall, and a wrist portion cooperatively joined together to fit a wearer's hand and a pocket provided intermediate the wrist portion and the thumb stall of the glove wherein the pocket is adapted for receiving a generally flexible conforming weight capable of conforming in use to the shape of the ball of the thumb of a wearer's hand.

In these respects, the Weighted Golf Glove according to the present invention substantially departs from the conventional concepts and designs of the prior art, and in so doing provides an apparatus primarily developed for the purpose of improving a golfer's golf swing and thereby helping a golfer improve his or her golf game.

SUMMARY OF THE INVENTION

In view of the foregoing disadvantages inherent in the known types of weighted gloves now present in the prior art, the present invention provides a new Weighted Golf Glove construction wherein the same can be utilized for improving a golfer's golf swing and thereby helping a golfer improve his or her golf game.

The general purpose of the present invention, which will be described subsequently in greater detail, is to provide a new Weighted Golf Glove apparatus and method which has many of the advantages of the weighted gloves mentioned heretofore and many novel features that result in a new Weighted Golf Glove which is not anticipated, rendered obvious, suggested, or even implied by any of the prior art weighted gloves, either alone or in any combination thereof.

To attain this, the present invention generally comprises a glove including a palm portion, a back portion, finger stalls, a thumb stall, and a wrist portion cooperatively joined together to fit a wearer's hand and a pocket provided intermediate the wrist portion and the thumb stall of the glove wherein the pocket is adapted for receiving a generally flexible conforming weight capable of conforming in use to the shape of the ball of the thumb of a wearer's hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Weighted Golf Glove apparatus and method which has many of the advantages of the weighted gloves mentioned heretofore and many novel features that result in a new Weighted Golf Glove which is not anticipated, rendered obvious, suggested, or even implied by any of the prior art weighted gloves, either alone or in any combination thereof.

It is another object of the present invention to provide a new Weighted Golf Glove which may be easily and efficiently manufactured and marketed.

It is a further object of the present invention to provide a new Weighted Golf Glove which is of a durable and reliable construction.

An even further object of the present invention is to provide a new Weighted Golf Glove which is susceptible of a low cost of manufacture with regard to both materials and labor, and which accordingly is then susceptible of low prices of sale to the consuming public, thereby making such Weighted Golf Glove economically available to the buying public.

Still yet another object of the present invention is to provide a new Weighted Golf Glove which provides in the apparatuses and methods of the prior art some of the advantages thereof, while simultaneously overcoming some of the disadvantages normally associated therewith.

Still another object of the present invention is to provide a new Weighted Golf Glove for improving a golfer's golf swing and thereby helping a golfer improve his or her golf game.

Yet another object of the present invention is to provide a new Weighted Golf Glove which includes a glove including a palm portion, a back portion, finger stalls, a thumb stall, and a wrist portion cooperatively joined together to fit a wearer's hand and a pocket provided intermediate the wrist portion and the thumb stall of the glove wherein the pocket is adapted for receiving a generally flexible conforming weight capable of conforming in use to the shape of the ball of the thumb of a wearer's hand.

Still yet another object of the present invention is to provide a new Weighted Golf Glove that would generate momentum as a golfer swings a golf club thereby keeping the golfer's hands and the golf club moving in the correct plane so that the golf club approaches the golf ball on a desired path (inside to outside).

Even still another object of the present invention is to provide a new Weighted Golf Glove that would cause a golfer's hands to roll forward in a natural releasing motion as they enter the hitting zone of the golf swing thereby providing maximum clubhead acceleration and squaring the clubface at impact with the golf ball such that the maximum amount of force is transmitted to the golf ball and the golf ball flies straight.

Even still another object of the present invention is to provide a new Weighted Golf Glove that allows for proper follow-through during a golf swing thus resulting in longer, straighter, and more accurate golf shots.

Even still another object of the present invention is to provide a new Weighted Golf Glove that reduces slicing whereby the added weight assists a golfer in directing a golf club through a golf ball during a golf swing as opposed to coming across (outside to inside) or over the golf ball which has a tendency to create slicing.

Even still another object of the present invention is to provide a new Weighted Golf Glove that would replicate a weighted practice club so as to help a golfer to develop and strengthen muscles used during a golf swing and thus swing harder and hit longer shots.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
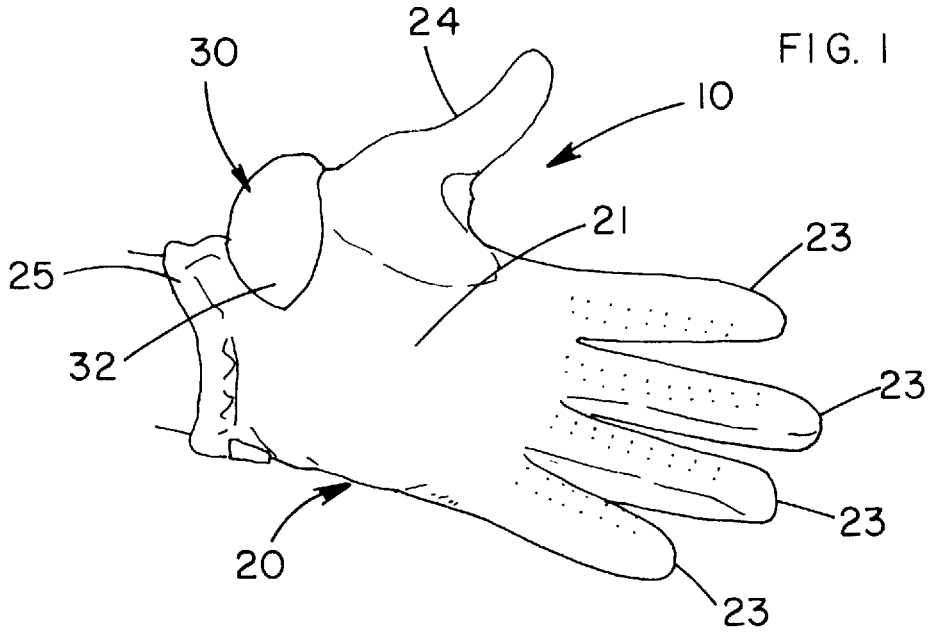
FIG. 1 is an illustration of a new Weighted Golf Glove according to the present invention.
Figure 2:
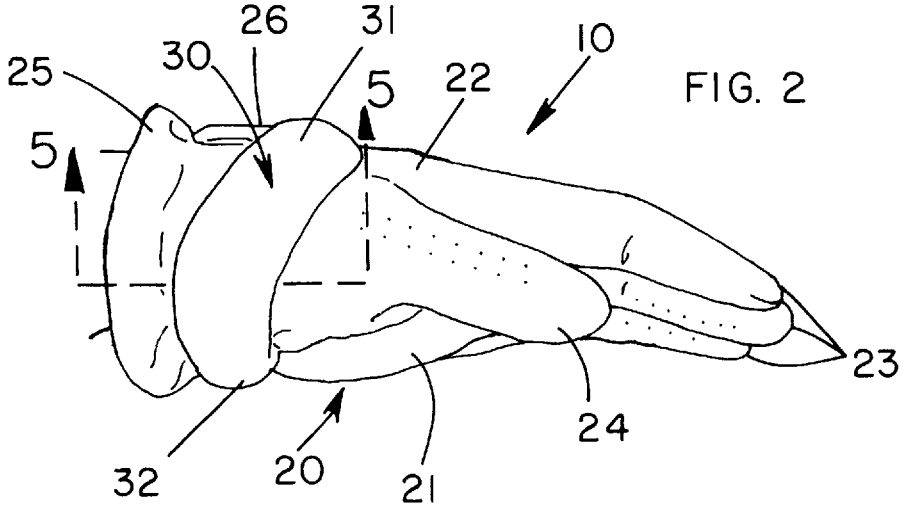
FIG. 2 is a side view of the present invention.

With reference now to the drawings, and in particular to FIGS. 1 through 5 thereof, a new Weighted Golf Glove embodying the principles and concepts of the present invention and generally designated by the reference numeral 10 will be described.

More specifically, it will be noted that the Weighted Golf Glove 10 comprises a glove 20 including a palm portion 21, a back portion 22, finger stalls 23, a thumb stall 24, and a wrist portion 25 cooperatively joined together to fit a wearer's hand and a pocket 30 provided intermediate the wrist portion 25 and the thumb stall 24 of the glove 20 wherein the pocket 30 is adapted for receiving and holding a generally flexible conforming weight 40 capable of conforming in use to the shape of the ball of the thumb of a wearer's hand.

As best illustrated in FIGS. 1 through 4, it can be shown that the glove 20 includes a palm portion 21 covering the palm of the wearer's hand and a back portion 22 overlying the back of the wearer's hand. The glove 20 includes finger stalls 23 and a thumb stall 24 for receiving the fingers and the thumb, respectively, of the wearer's hand. The glove 20 also includes a wrist portion 25 substantially encircling the wrist of the wearer's hand.

As best illustrated in FIGS. 1 through 4, it can be shown that the pocket 30 is provided intermediate the wrist portion 25 of the glove 20 and the thumb stall 24 of the glove 20. The pocket 30 traverses the ball of the thumb of the wearer and has a first end 31 on the back portion 22 of the glove 20 and a second end 32 on the palm portion 21 of the glove 20. The pocket 30 is adapted for receiving and holding the generally flexible conforming weight 40. As such, the generally flexible conforming weight 40 straddles the shaft 3 of a golf club 2 when the wearer grips the handle 4 of the golf club 2.

Figure 4:
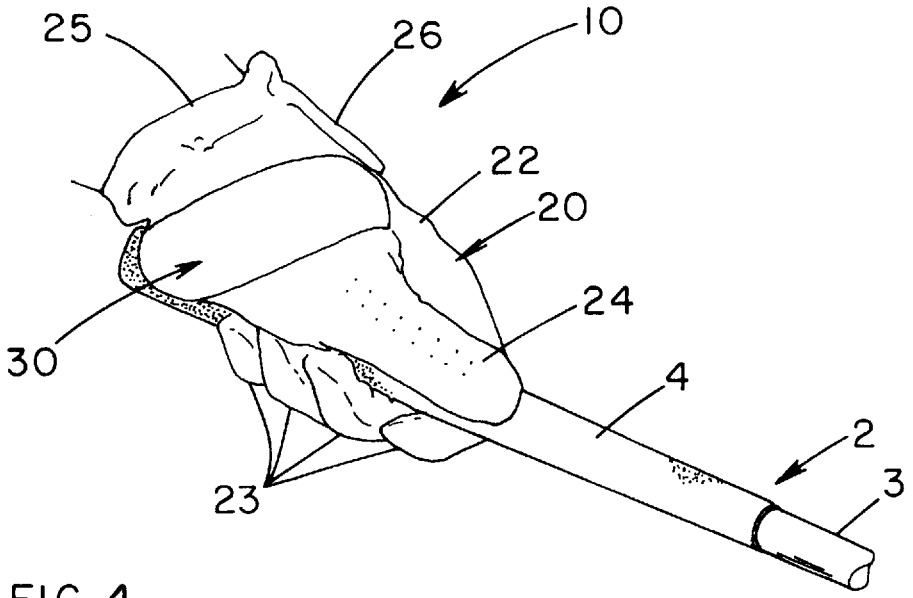
FIG. 4 is an illustration of the present invention in use.
Figure 5:
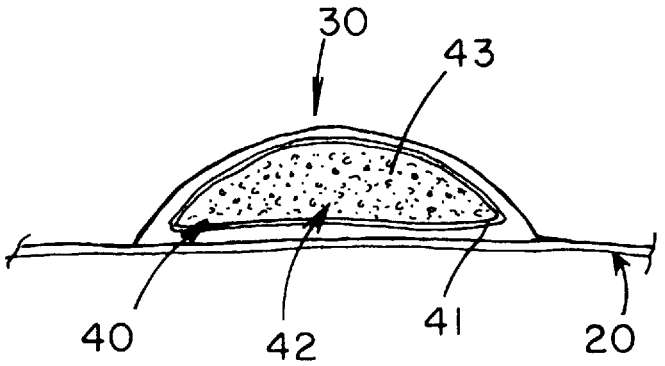
FIG. 5 is a cross sectional view taken along line 5—5 of FIG. 2.

The generally flexible conforming weight 40 is capable of conforming in use to the shape of the ball of the thumb of the wearer's hand. As best illustrated in FIG. 4, it can be shown that the generally flexible conforming weight 40 comprises a pouch 41 and a weighted material 42 disposed within the pouch 41. The weighted material 42 comprises a granular material 43 such as sand, lead powder, or lead shot. The pouch 41 is formed of a waterproof material such that the granular material 43 disposed within the pouch 41 is isolated from moisture. The generally flexible conforming weight 40 has a weight in the range of about eight (8) to twelve (12) ounces. In an illustrative embodiment, the generally flexible conforming weight 40 has a weight of ten (10) ounces.

Figure 3:
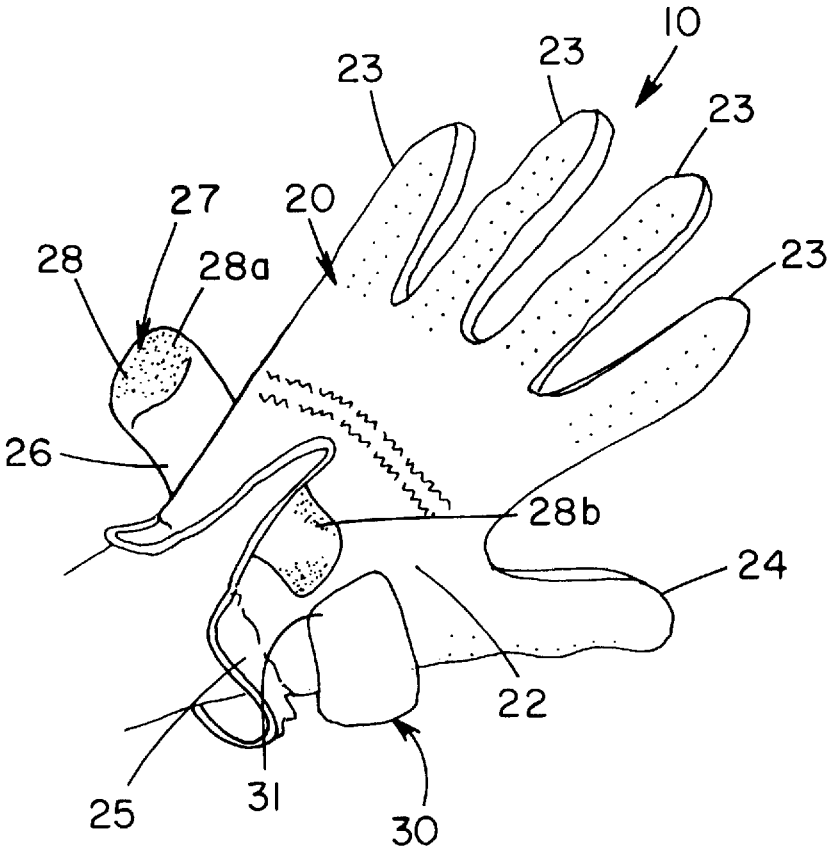
FIG. 3 is a top view of the present invention.

As best illustrated in FIG. 3, it can be shown that the wrist portion 25 of the glove 20 includes a strap 26 for securing the glove 20 to the wearer's hand. A releasable fastener 27 is provided on the strap 26 for releasably fastening the strap 26 to the back portion 22 of the glove 20. The releasable fastener 27 comprises a hook and loop fastener 28 including a hook portion 28*a* provided on the strap 26 and a mating loop portion 28*b* provided on the back portion 22 of the glove 20.

In use, a wearer of the Weighted Golf Glove 10 inserts his or her fingers into the finger stalls 23 and his or her thumb into the thumb stall 24. The wearer secures the Weighted Golf Glove 10 to his or her hand by pulling the strap 26 across the back portion 22 of the glove 20 towards the thumb stall 24 and releasably fastens the strap 26 to the back portion 22 of the glove 20 with the releasable fastener 27. As such, the pocket 30, provided intermediate the wrist portion 25 and the thumb stall 24 of the glove 20, traverses the ball of the thumb of the wearer. The generally flexible conforming weight 40 contained within the pocket 30 conforms to the shape of the ball of the thumb of the wearer's hand. When the wearer of the Weighted Golf Glove 10 grips the handle 4 of a golf club 2, the generally flexible conforming weight 40 straddles the shaft 3 of the golf club 2. As the wearer of the Weighted Golf Glove 10 swings the golf club 2, the generally flexible conforming weight 40 generates momentum thereby keeping the wearer's hands and the golf club 2 moving in the correct plane so that the golf club 2 approaches the golf ball on the desired inside to outside path.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Weighted Golf Glove comprising:

a glove including a palm portion, a back portion, finger stalls, a thumb stall, and a wrist portion cooperatively joined together to fit a wearer's hand;

a generally flexible conforming weight capable of conforming in use to the shape of the ball of the thumb of the wearer's hand; and a pocket provided intermediate said wrist portion of said glove and said thumb stall of said glove on the ball of the thumb said pocket adapted for receiving and holding said generally flexible conforming weight.

2. The Weighted Golf Glove of claim 1, wherein said pocket traverses the ball of the thumb of the wearer's hand and has a first end on said back portion of said glove and a second end on said palm portion of said glove.

3. The Weighted Golf Glove of claim 1, wherein said generally flexible conforming weight comprises:

a pouch, and a weighted material disposed within said pouch.

4. The Weighted Golf Glove of claim 3, wherein said weighted material comprises a granular material.

5. The Weighted Golf Glove of claim 4, wherein said granular material is at least one of sand, lead powder, and lead shot.

6. The Weighted Golf Glove of claim 1, wherein said generally flexible conforming weight has a weight in the range of about eight to twelve ounces.

7. The Weighted Golf Glove of claim 1, wherein said generally flexible conforming weight has a weight of ten ounces.

8. The Weighted Golf Glove of claim 1, wherein said wrist portion of said glove includes a strap for securing said glove to the wearer's hand, said strap including a releasable fastener for releasably fastening said strap to said back portion of said glove.

9. The Weighted Golf Glove of claim 8, wherein said releasable fastener comprises a hook and loop fastener including a hook portion provided on said strap and a mating loop portion provided on said back portion of said glove.

10. A Weighted Golf Glove comprising:

a glove including a palm portion, a back portion, finger stalls, a thumb stall, and a wrist portion cooperatively joined together to fit a wearer's hand;

a generally flexible conforming weight capable of conforming in use to the shape of the ball of the thumb of the wearer's hand; and a pocket provided intermediate said wrist portion of said glove and said thumb stall of said glove, said pocket traversing the ball of the thumb of the wearer's hand and having a first end on said back portion of said glove and a second end on said palm portion of said glove, said pocket adapted for receiving and holding said generally flexible conforming weight.

11. The Weighted Golf Glove of claim 10, wherein said generally flexible conforming weight comprises:

a pouch, and a weighted material disposed within said pouch.

12. The Weighted Golf Glove of claim 11, wherein said weighted material comprises a granular material.

13. The Weighted Golf Glove of claim 12, wherein said granular material is at least one of sand, lead powder, and lead shot.

14. The Weighted Golf Glove of claim 10, wherein said generally flexible conforming weight has a weight in the range of about eight to twelve ounces.

15. The Weighted Golf Glove of claim 10, wherein said generally flexible conforming weight has a weight of ten ounces.

16. The Weighted Golf Glove of claim 10, wherein said wrist portion of said glove includes a strap for securing said glove to the wearer's hand, said strap including a releasable fastener for releasably fastening said strap to said back portion of said glove.

17. The Weighted Golf Glove of claim 16, wherein said releasable fastener comprises a hook and loop fastener including a hook portion provided on said strap and a mating loop portion provided on said back portion of said glove.

18. A Weighted Golf Glove comprising:

a glove including a palm portion, a back portion, finger stalls, a thumb stall, and a wrist portion cooperatively joined together to fit a wearer's hand;

a pouch;

a weighted material disposed within said pouch, said weighted material capable of conforming in use to the shape of the ball of the thumb of the wearer's hand; and a pocket provided intermediate said wrist portion of said glove and said thumb stall of said glove, said pocket traversing the ball of the thumb of the wearer's hand and having a first end on said back portion of said glove and a second end on said palm portion of said glove, said pocket adapted for receiving and holding said pouch.

19. The Weighted Golf Glove of claim 18, wherein said weighted material comprises a granular material.

20. The Weighted Golf Glove of claim 18, wherein said weighted material has a weight in the range of about eight to twelve ounces.

* * * * *